US011484811B2

(12) United States Patent
Cantoli-Alves et al.

(10) Patent No.: US 11,484,811 B2
(45) Date of Patent: Nov. 1, 2022

(54) FIDGET ACCESSORY AND SYSTEM FOR PROVIDING THE SAME

(71) Applicant: PopSockets LLC, Boulder, CO (US)

(72) Inventors: Vanessa Cantoli-Alves, Boulder, CO (US); David Willson, Boulder, CO (US); Ivan Chen, Boulder, CO (US); Michael J. Kory, Boulder, CO (US); David Czarenecki, Boulder, CO (US); Lawrence Herman Fong, Boulder, CO (US); Randy Yang Chiang, Boulder, CO (US); David B. Barnett, Boulder, CO (US)

(73) Assignee: POPSOCKETS LLC, Boulder, CO (US)

( * ) Notice: Subject to any disclaimer, the term of this patent is extended or adjusted under 35 U.S.C. 154(b) by 0 days.

(21) Appl. No.: 17/037,383

(22) Filed: Sep. 29, 2020

(65) Prior Publication Data

US 2022/0096949 A1 Mar. 31, 2022

(51) Int. Cl.
*A63H 33/26* (2006.01)

(52) U.S. Cl.
CPC ..... *A63H 33/26* (2013.01)

(58) Field of Classification Search
CPC ..... A63H 33/26
USPC ..... 273/239
See application file for complete search history.

(56) References Cited

U.S. PATENT DOCUMENTS 3,278,011 A * 10/1966 Viemeister ..... B65D 51/24 206/457
3,406,972 A * 10/1968 Wong ..... A63F 3/0457 273/118 A
3,572,719 A * 3/1971 Span ..... A63F 7/0088 273/139
3,680,865 A * 8/1972 Davis ..... A63F 3/00694 273/239
3,706,158 A * 12/1972 Jensen ..... A63H 33/26 446/92
4,013,293 A * 3/1977 Hess ..... A63F 3/00694 273/239
4,021,042 A * 5/1977 Sweeton ..... A63F 3/00694 273/239
4,307,886 A * 12/1981 Kemper ..... A63F 9/1204 273/157 R
4,741,534 A * 5/1988 Rogahn ..... A63F 9/1204 273/157 R
4,902,011 A * 2/1990 Seaton ..... A63F 9/34 273/449

(Continued)

OTHER PUBLICATIONS

Transmittal of the International Search Report and Written Opinion issued in PCT/US2021/049053 dated Sep. 24, 2021.

*Primary Examiner* — Eugene L Kim
*Assistant Examiner* — Matthew B Stanczak
(74) *Attorney, Agent, or Firm* — Irell & Manella LLP

(57) ABSTRACT

A fidget accessory which includes a plurality of stones that geometrically cooperate with a bowl. The bowl includes a bowl base on which the plurality of stones are configured to be arranged in a base orientation. The bowl includes a bowl lip circumferentially surrounding a top edge of the bowl, and a bowl ramp extending between the bowl lip and the bowl base. One or more magnets in the bowl base have a polarity opposite to corresponding magnets in the plurality of stones such that the plurality of stone are magnetically engaged with the bowl.

13 Claims, 7 Drawing Sheets

(56) References Cited

U.S. PATENT DOCUMENTS

| | | | | | |
|---|---|---|---|---|---|
| 5,072,936 | A | | 12/1991 | Warehime | |
| 5,265,885 | A | * | 11/1993 | Blount | A63F 9/34 273/239 |
| 5,347,253 | A | * | 9/1994 | Ogikubo | A63F 9/12 273/239 |
| 5,421,581 | A | * | 6/1995 | Smith | A63F 3/00694 273/239 |
| 5,839,727 | A | * | 11/1998 | Stillinger | A63F 3/00697 273/271 |
| 6,238,216 | B1 | * | 5/2001 | Menelly | G09B 27/00 434/134 |
| 7,458,722 | B2 | * | 12/2008 | Chen | F16C 29/0685 384/446 |
| 9,914,063 | B1 | * | 3/2018 | McCoskery | A63H 29/08 |
| D819,143 | S | * | 5/2018 | Lyon | D21/398 |
| 10,300,367 | B1 | * | 5/2019 | Douglas, Jr. | A63F 3/00694 |
| 2010/0255751 | A1 | * | 10/2010 | Bowes | A63H 33/26 446/137 |
| 2013/0106055 | A1 | * | 5/2013 | Knox | A63F 3/00694 273/239 |
| 2015/0196837 | A1 | * | 7/2015 | Stromberg | A63F 3/00694 273/239 |
| 2015/0298021 | A1 | * | 10/2015 | Vicentelli | A63F 9/0807 446/129 |
| 2017/0216737 | A1 | * | 8/2017 | Kiribuchi | A63H 33/046 |
| 2018/0342930 | A1 | * | 11/2018 | Roberts | A63H 1/00 |
| 2019/0030424 | A1 | * | 1/2019 | Chen | A63F 13/213 |
| 2019/0038991 | A1 | * | 2/2019 | Schiraga | H01L 33/0045 |
| 2019/0099688 | A1 | * | 4/2019 | Umberger | A63H 5/00 |
| 2019/0176022 | A1 | * | 6/2019 | Lee | A63F 3/02 |
| 2020/0061483 | A1 | * | 2/2020 | Hamel | A63H 33/00 |

* cited by examiner

FIDGET ACCESSORY AND SYSTEM FOR PROVIDING THE SAME

BACKGROUND OF THE INVENTION

Technical Field

The present disclosure relates to a fidget accessory, and more particularly to a fidget accessory having a bowl-and-stone arrangement which is based on complementary geometries and magnetic interactions therebetween.

Description of the Related Art

Many fidget accessories are based on a spinner arrangement in which a base supports an outer revolving member. The user holds the base in his/her hand and spins the revolving vehicle around the base. A bearing is generally disposed between the base and revolving vehicle to facilitate the spinning action. Such a "fidget spinner" is based on the concept that such a spinner would calm people who tend to fidget, acting as a release mechanism for nervous energy, anxiety and the like.

While known fidget spinners may provide some beneficial calming effect, they represent only one approach and may not impart the same or any calming effect for all users and/or may not impart an optimal level of calming for any particular user. For example, such spinners are based on the user creating a continuous motion of the spinner, as opposed to creating motion or movement only in response to a specific user action. As such, there is an ongoing need in the art for an improved fidget accessory that can provide beneficial calming or stress-reducing effects for users based on alternative approaches, including those that do not depend on continuous motion.

SUMMARY OF THE INVENTION

The present disclosure relates to a fidget accessory which includes a plurality of stones. Each of the stones includes a stone lid, a stone body, and at least one stone magnet disposed inside the stone body of each of the plurality of stones. The fidget accessory further includes a bowl having a bowl base disposed at a bottom of the bowl on which the plurality of stones are configured to be arranged in a base orientation. The bowl includes a bowl lip circumferentially surrounding a top edge of the bowl, and a bowl ramp extending between the bowl lip and the bowl base. The bowl further includes one or more bowl magnets contained in the bowl base with a polarity opposite to corresponding ones of the stone magnets at least when the plurality of stones are arranged in the base orientation, wherein the one or more bowl magnets are configured to magnetically interact with the stone magnets.

The present disclosure further relates to a fidget accessory which includes first and second stones, and a bowl. Each of the first and second stones include a stone lid, a stone body, and first and second stone magnets are disposed inside the first and second stones respectively. The bowl includes a bowl base disposed at a bottom of the bowl, and on which the first and second stones are configured to be arranged side by side adjacent to each other in a base orientation. The bowl includes a bowl magnet contained in the bowl base and has a polarity opposite to that of the first and second stone magnets, wherein the bowl magnet is configured to magnetically interact with the first and second stone magnets. The bowl, and the first and second stones have complimentary geometries and magnetic interactions therebetween, which cause the first stone to dislodge from the base orientation and move towards the second stone upon application of an external user force to the first stone in an upward direction, and which further causes each of the first and second stones to remain magnetically engaged with one of the bowl and corresponding other stone upon application of the external user force.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein:

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION OF THE EMBODIMENTS

The present disclosure generally relates to a fidget accessory that includes a plurality of stones configured to geometrically cooperate with a bowl. The bowl includes a bowl base on which the plurality of stones are configured to be arranged in a base orientation. The bowl includes a bowl lip circumferentially surrounding a top edge of the bowl, and a bowl ramp extending between the bowl lip and the bowl base. One or more magnets in the bowl base have a polarity opposite to corresponding magnets in the plurality of stones such that the plurality of stone are magnetically engaged with the bowl. In one or more embodiments, the fidget accessory is configured to allow a user to engage in fidget-based manual manipulation of the positions of the stones relative to the bowl and to each other thereby imparting a calming and stress-reducing effect on the user.

Figure 1:
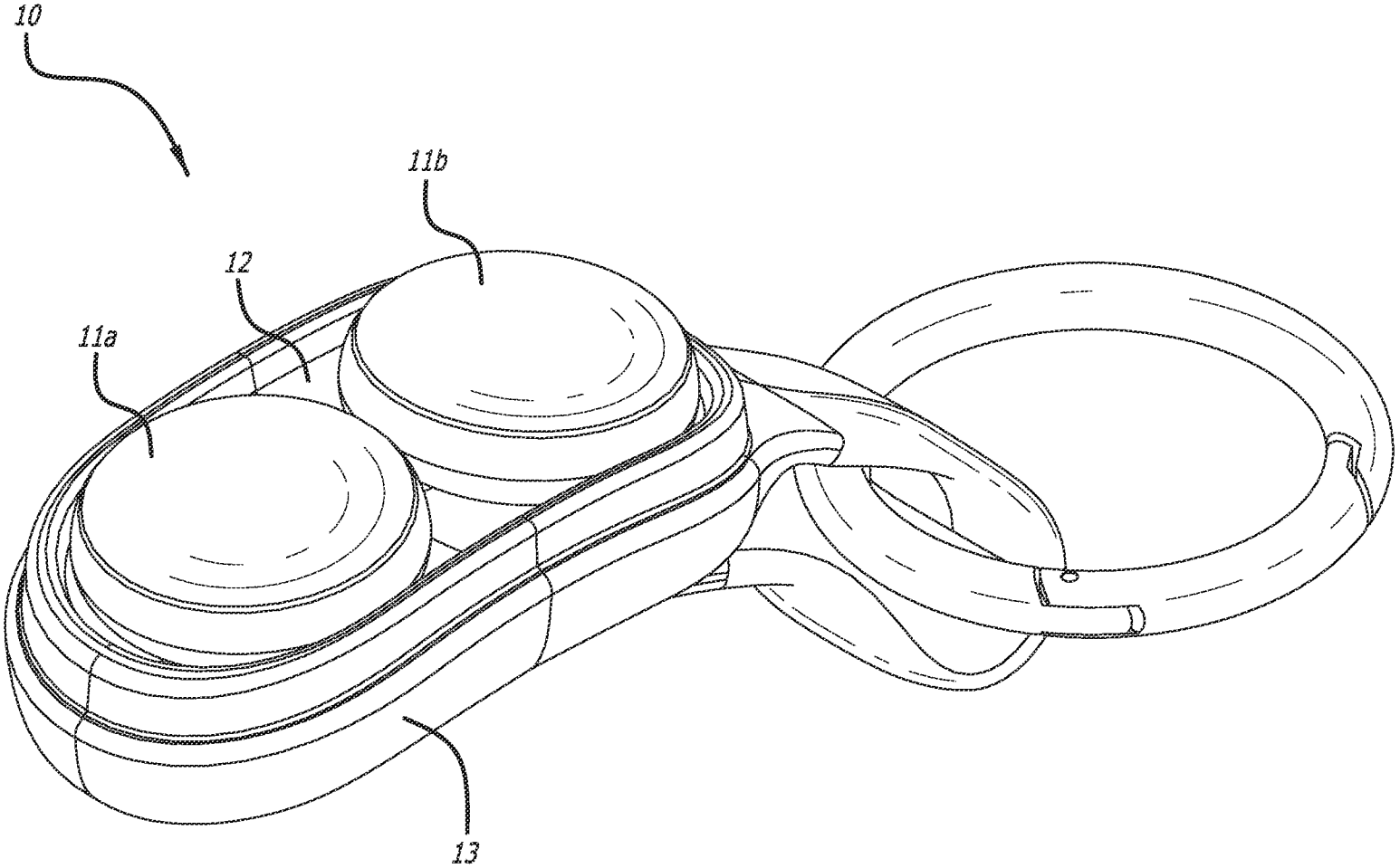
FIG. 1 illustrates a perspective view of a fidget accessory, in accordance with an embodiment of the present disclosure.

Referring now to the drawings, FIG. 1 illustrates a fidget accessory 10, in accordance with an embodiment of the present disclosure. The fidget accessory 10 includes first and second stones 11*a* and 11*b* magnetically engaged with a bowl 12, where the bowl 12 is optionally engaged with a leash portion 13 magnetically or otherwise. The first and second stones 11*a* and 11*b* may be arranged adjacent to each other, as shown in FIG. 1, such that they magnetically engage with the bowl 12 by virtue of one or more magnets disposed within the first and second stones 11*a* and 11*b*, and one or more opposite pole magnets disposed within a base of the bowl 12. Although, two stones are shown herein, it would be apparent to one of ordinary skill in the art, that the fidget accessory 10 may include less than or more than two stones arranged within the bowl 12.

Figure 2:
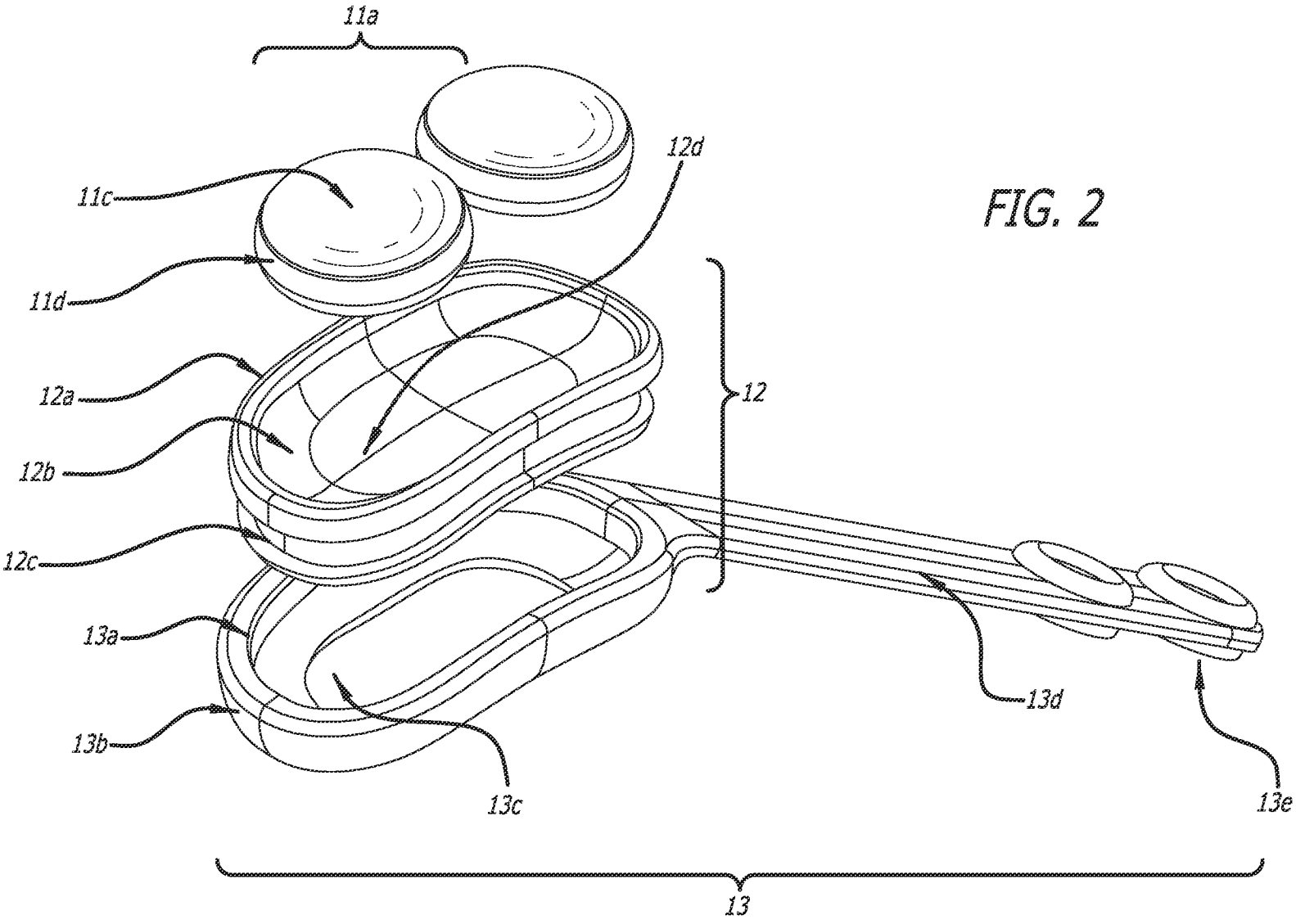
FIG. 2 illustrates an exploded view of the fidget accessory of FIG.1, together with a further leash portion, in accordance with an embodiment of the present disclosure.

FIG. 2 illustrates an exploded view of the fidget accessory 10 of FIG. 1, configured with a different embodiment of the leash portion 13 in accordance with the present disclosure. As with FIG. 1, each of the first and second stones 11*a* and 11*b* include a stone 11*d* defining one side of the stone, a stone body, and a stone magnet disposed within the stone body. For example, the first stone 11*a* includes a stone lid 11*c*, a stone body 11*d* and a stone magnet (not shown) arranged within the stone body 11*d*.

Continuing to refer to FIG. 2, the bowl 12 is configured with a bowl lip 12*a*, a bowl ramp 12*b*, a bowl channel 12*c* and one or more bowl magnets (not shown) disposed within a base of the bowl 12*d*. The bowl 12 is circumferentially surrounded by a bowl channel 12*c*, as shown in FIG. 2. Moreover, the bowl lip 12*a* is formed as an inwardly protruding perimeter disposed around a top edge of the bowl ramp 12*b*. The bowl ramp 12*b* is defined by a curved region connecting the bowl lip 12*a* and bowl base 12*d*. The bowl ramp 12*b* has a ramp profile that is concave shaped so as to cooperate with the stone bodies (e.g., body 11*d*) of the first and second stones 11*a* and 11*b*. The innovative shape of the bowl ramp 12*b* is configured to cooperatively accommodate one or more stones (here, the first and second stones 11*a* and 11*b*) by having a ramp profile that facilitates movement of the stones therealong, as shown in more detail in FIGS. 4A-4B, for example. This cooperative arrangement is based, not only on the complementary shapes of the bowl ramp 12*b* and stone bodies (e.g., body 11*d*), but also on magnetic interactions. As described above and below, these magnetic interactions are provided by one or more magnets disposed within the first and second stones 11*a* and 11*b*, with one or more opposite pole magnets disposed within the bowl base 12*d*. This combination of complimentary geometries and magnetic interactions between the bowl ramp 12*b* and the one or more stones (e.g., stones 11*a* and 11*b*) provides a fidget-based mechanism by which the user may be able to reduce nervous energy, anxiety or psychological stress.

Referring back to FIG. 2, the leash 13 includes a leash collar 13*a*, a leash wrap 13*b*, a leash hole 13*c*, a leash tail 13*d*, a magnetic cap 13*e*, and leash magnet (not shown). In accordance with an embodiment of the present disclosure, the bowl channel 12*c* is configured to cooperatively accept the leash collar 13*a* of the leash wrap 13*b*. It should be appreciated that the leash collar 13*a* may be configured to form a snap-fit with the bowl channel 12*c*, thereby securing the leash 13 to the bowl 12 in a fixed, but temporary or reversible manner. In this manner, different embodiments of leash 13 can be connected to and disconnected from the bowl 12.

Figure 3C:
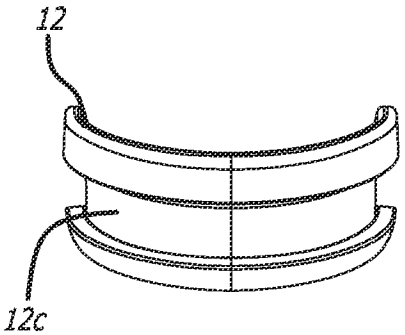
FIGS. 3A-3C illustrate side and end views of a bowl of the fidget accessory of FIG. 1, in accordance with an embodiment of the present disclosure.
Figure 3B:
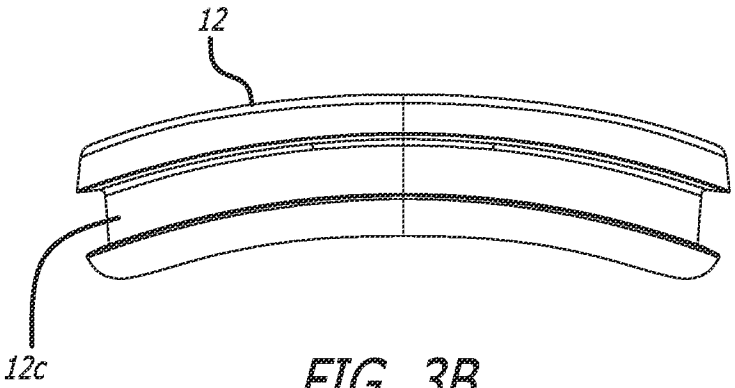
Figure 3A:
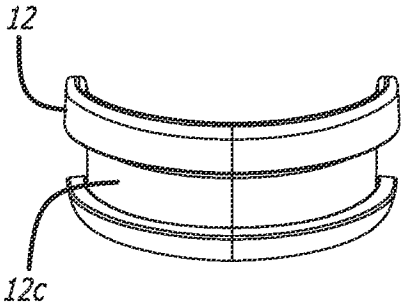

Referring now to FIGS. 3A-3C, illustrated are end and side views of the bowl 12 in accordance with the present disclosure. As shown, channel 12*c* is disposed along an exterior side of the bowl 12, forming a circumferential indention around the bowl 12.

Figure 4A:
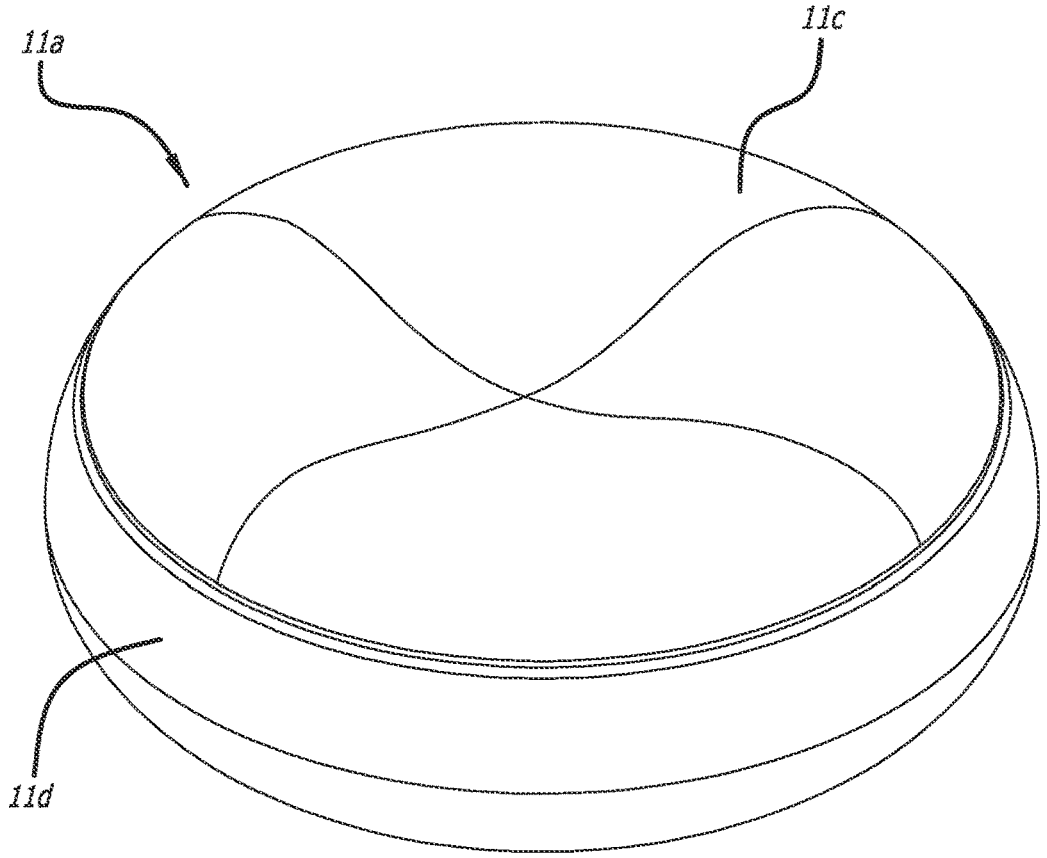
FIGS. 4A-4B illustrate perspective and side views, respectively, of a stone of the fidget accessory of FIG. 1, in accordance with an embodiment of the present disclosure.
Figure 4B:
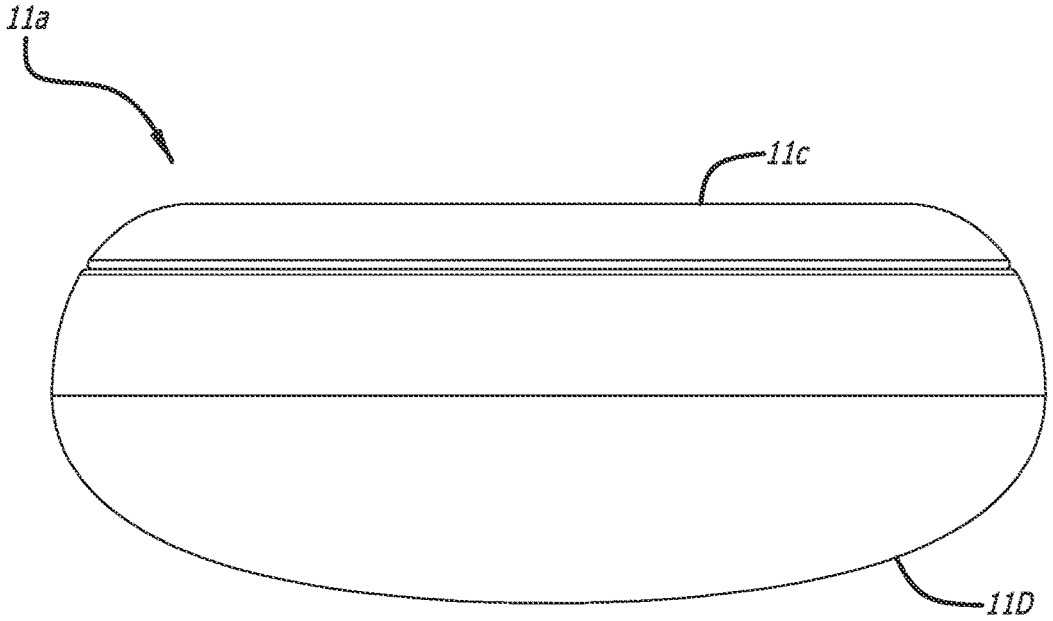

FIGS. 4A-4B illustrate one embodiment of the first stone 11*a* in accordance with the present disclosure. As shown in FIGS. 4A-4B, the lid 11*c* may comprise a concave shape which complements a curvature of the stone body 11*d* such that the stones of the present disclosure may be stacked vertically in an engaging manner, as shown and described in more detail below.

Figure 5A:
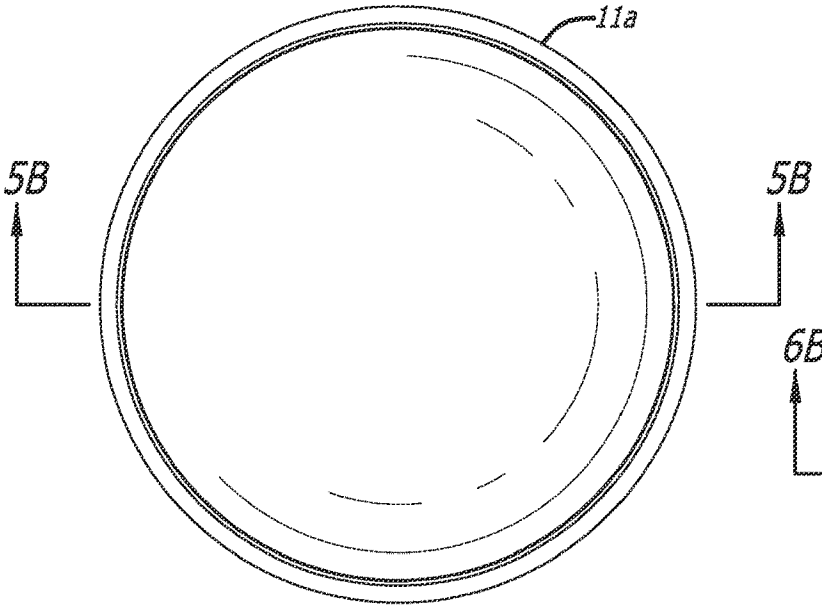
FIGS. 5A-5B illustrate a sectional view of a stone of the fidget accessory of FIG. 1, in accordance with an embodiment of the present disclosure.
Figure 5B:
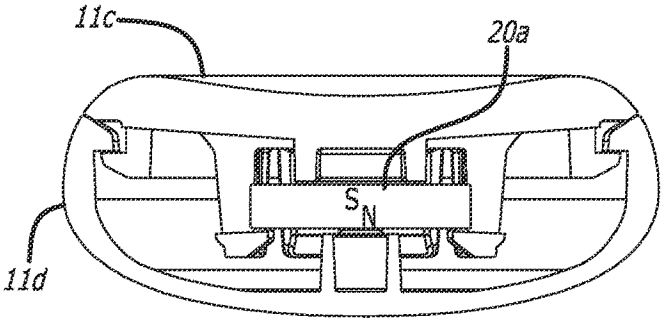

Referring now to FIGS. 5A-5B, illustrated is a top view and a cross-sectional view of the first stone 11*a* in which a stone magnet 20*a* is disposed inside the stone body 11*d*. In one or more embodiments, the complementary geometries between the stone lid lie and stone body 11*d*, in combination with a stone magnet 20*a* being disposed within the stone body as shown in FIGS. 5A-5B, provides a configuration in which multiple stones may be stacked (e.g., placed one on top of each other) in an engaging manner.

Figure 6A:
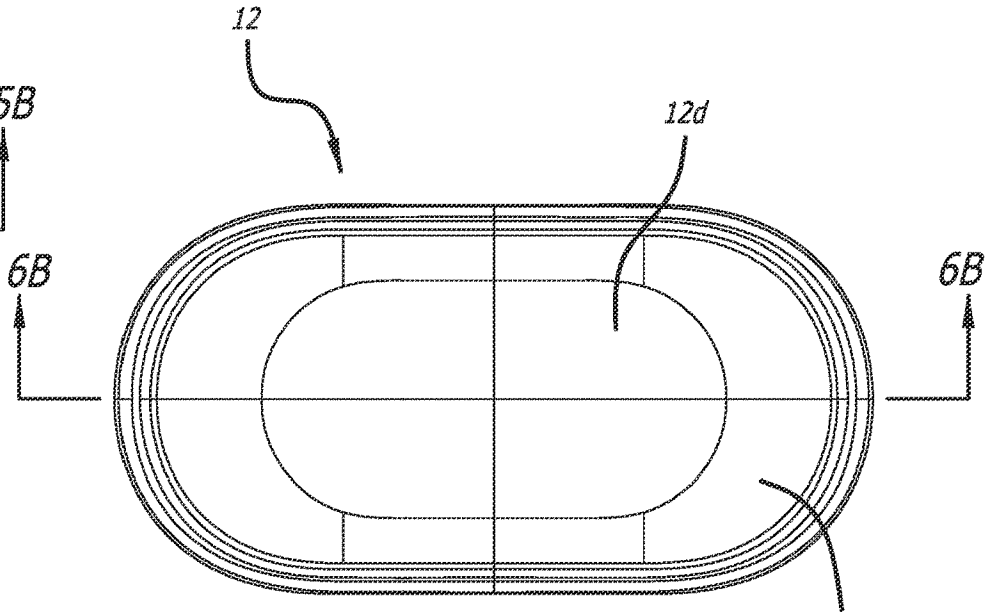
FIGS. 6A-6B illustrate a sectional view of a bowl of the fidget accessory of FIG. 1, in accordance with an embodiment of the present disclosure.
Figure 6B:
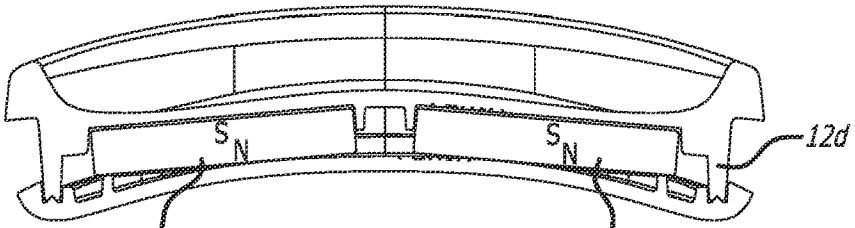

FIGS. 6A-6B are a top view and FIC. 6 is a cross-sectional view of bowl 12 illustrating first and second bowl magnets 24*a* and 24*b* disposed side by side inside the bowl base 12*d*. In one or more embodiments of the present disclosure, the first bowl magnet 24*a* may be configured to interact primarily with the opposite pole stone magnet 20*a* of the first stone 11*a* (see e.g., FIGS. 5A-5B), while the second bowl magnet 24*b* may be configured to magnetically interact with an opposite pole stone magnet (not shown) of the second stone 11*b*, such that the first and second stones 11*a* and 11*b* remain magnetically engaged with the bowl 12. It should be appreciated that the directions of the stone magnets and the corresponding first and second bowl magnets 24*a* and 24*b* are configured in such a manner that the first and second stones 11*a* and 11*b* remain magnetically engaged with the bowl base 12*d* until an external force is applied to the first and/or second stones 11*a* and 11*b* in a sufficient magnitude to overcome the magnetic attraction between the stones 11*a* and/or 11*b* and the bowl 12, thereby dislodging the stones 11*a* and 11*b* from the bowl base 12*d*. The complementary geometries of the stones 11*a* and/or 11*b* and bowl 12, together with the aforementioned magnetic interaction therebetween, provide an arrangement in which, as the stones 11*a* and/or 11*b* are dislodged from the bowl base 12*d* by said external force, the stones are made to travel up along the bowl ramp 12*b* or over or under each other, as further illustrated below.

FIGS. 7A-7H illustrate various orientations of the first and second stones 11*a* and 11*b*, in relation to the bowl 12 of the fidget accessory 10 that may occur in response to a user applying an exemplary force, for example, such as may occur while the user is fidgeting with the accessory 10. It should of course be appreciated that a user may engage in fidget-based manipulation of the stones by applying a wide range of forces to one or both of the stones 11*a* and 11*b*, and that such forces may be in any direction and have a range of magnitudes depending on the desired effect. Similarly, FIGS. 8A-8H depict cross sections of the first and second stones 11*a* and 11*b* and bowl 12 in the various orientations shown in FIGS. 7A-7H.

Figures 7A, 7B, 7C, 7D, 7E, 7F, 7G, 7H:
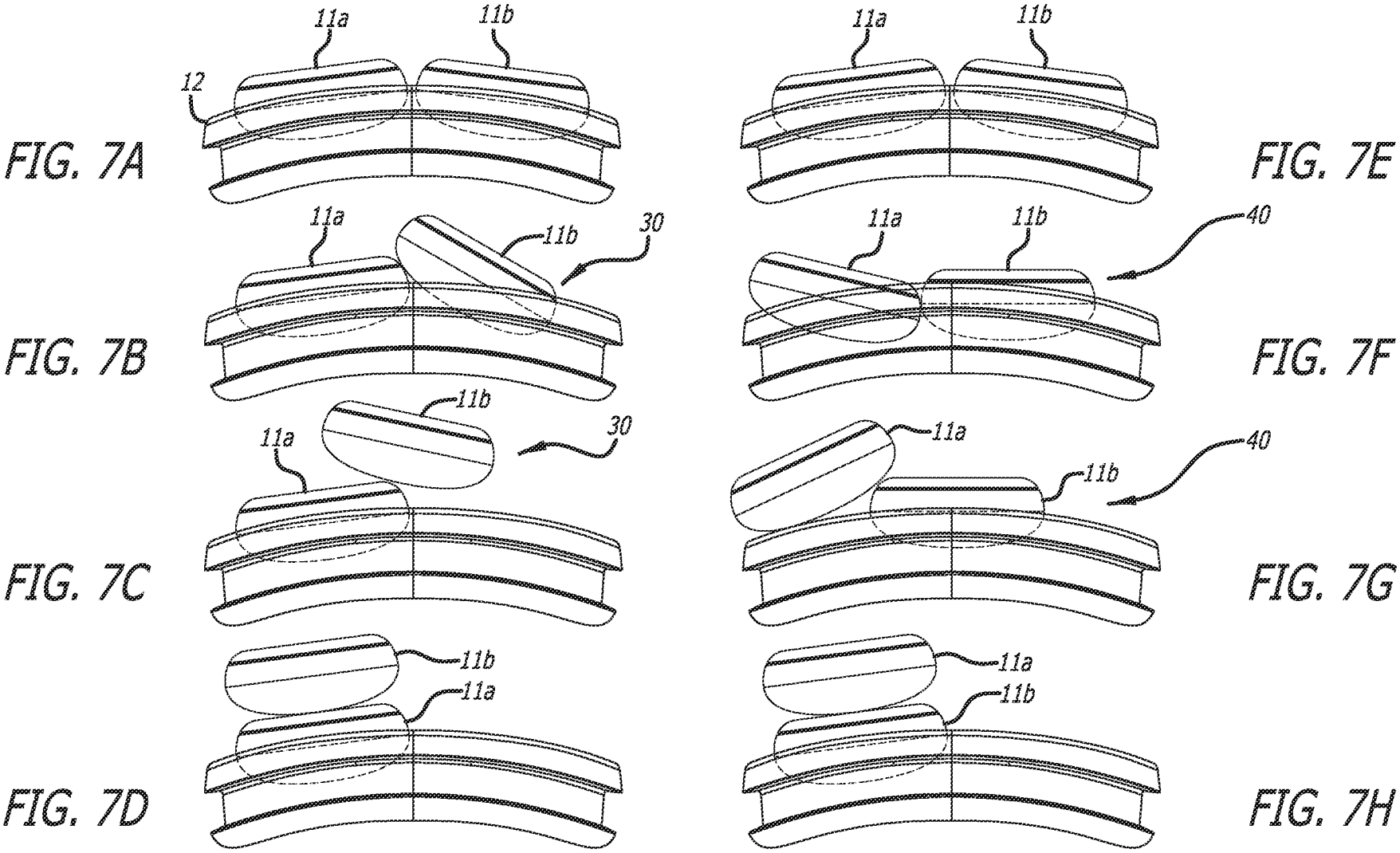
FIGS. 7A-7H illustrate various possible orientations of the stones and bowl of the fidget accessory of FIG. 1, in accordance with an embodiment of the present disclosure.
Figure 8A:
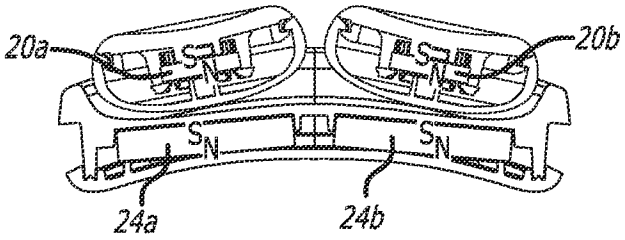
FIGS. 8A-8H illustrate various sectional views of the stones and bowl of the fidget accessory of FIG. 1 in the various possible orientations of FIGS. 7A-7H, in accordance with an embodiment of the present disclosure.
Figure 8B:
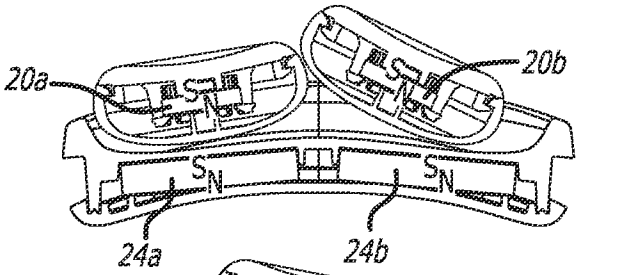
Figure 8C:
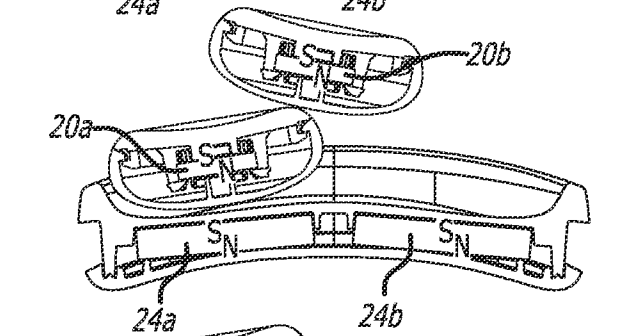
Figure 8D:
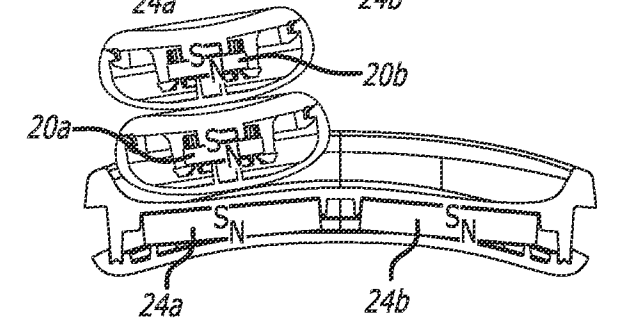
Figure 8E:
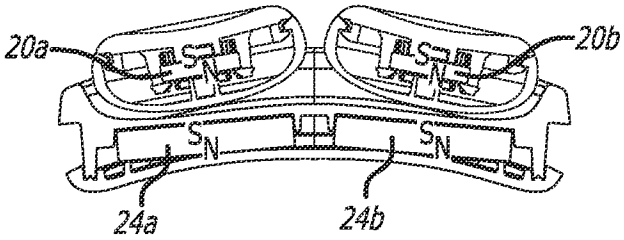
Figure 8F:
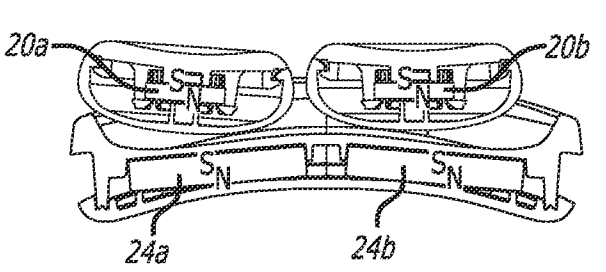
Figure 8G:
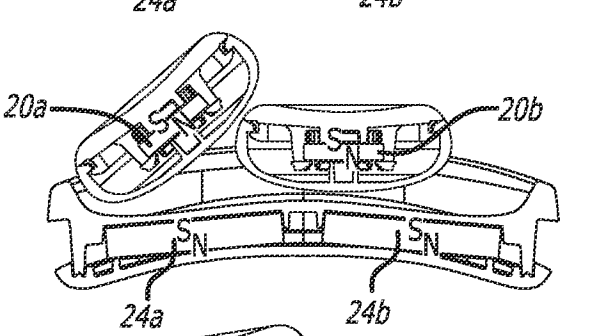
Figure 8H:
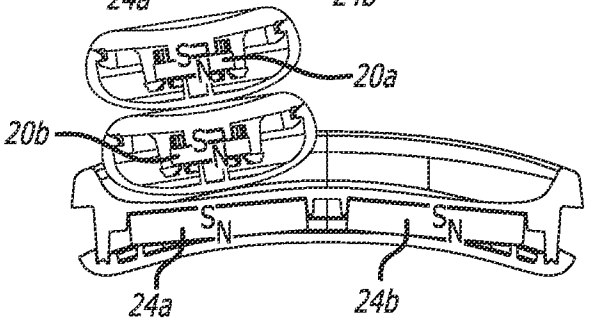

Referring first to FIG. 7A/8A, the first and second stones 11*a* and 11*b* are shown in a "base" orientation whereby the bowl magnets 24*a* and 24*b* and the corresponding stone magnets 20*a* and 20*b* are in their closest and most collinear orientation, and therefore experience a maximum magnetic attraction to securing the first and second stones 11*a* and 11*b* to a base of the bowl 12.

FIGS. 7B/8B illustrate the arrangement of FIGS. 7A/8A after an external user force 30 is applied to stone 11*b*, thereby causing the stone 11*b* to dislodge from its "base" orientation and to move towards stone 11*a*, as a function of the direction and magnitude of user force 30. In this fashion, user force 30 overcomes magnetic forces to separate the stone magnet 20*b* from the corresponding bowl magnet 24*b* such that they are no longer in their closest and most collinear orientation. As a result, the user experiences a reduced magnetic resistance when force 30 is continued to be applied.

Referring now to FIGS. 7C/8C, illustrated is a further arrangement in which external user force 30 is continued to be applied to stone 11*b*, thereby causing stone 11*b* to completely separate from the bowl and to move onto the adjacent stone 11*a*. As such, the magnetic attraction between stone magnet 20*b* from the corresponding bowl magnet 24*b* greatly reduces, which is experienced by the user in the continued application of force 30. At the same time, however, magnet 20*b* of stone 11*b* now experiences an attraction to the corresponding magnet 20*a* of stone 11*a* as a result of magnets 20*a* and 20*b* being moved closer to each other. Thus, not only does the user experience a greatly reduced magnetic resistance to force 30, but now in fact begins to experience the increasing attractive force between magnets 20*a* and 20*b*.

FIGS. 7D/8D illustrate the orientation in which external user force 30, together with the increasing magnetic attraction between magnets 20*a* and 20*b*, has caused stone 11*b* to completely slide to the other side of the bowl, thereby causing stone 11*b* to completely stack on adjacent stone 11*a*. Given the increasing magnetic attraction between magnets 20*a* and 20*b* as stone 11*b* moves on top of stone 11*a*, together with the complementary shape of the stones' bodies and lid as described above in FIGS. 4A-4B, the user may experience the application of force 30 as 'flipping' one stone on top of the other, or even 'snapping' into place in a stacked manner. The fidgeting experience may be particularly calming or stress-reducing in that, despite the user pushing the stone out of its base orientation, the user will not experience the feeling that the stone is ever at risk of falling or completely dislodging since, as one magnetic force decreases (i.e., between magnets 20*b* and 24*b*), another magnetic force is increasing (i.e., between magnets 20*a* and 20*b*).

FIGS. 7E/8E illustrate the same starting base orientation as FIGS. 7A/8A above. However, in contrast to force 30 of FIGS. 7B/8B, the user force 40 of FIGS. 7F/8F has a direction and magnitude that causes stone lib to dislodge from its "base" orientation and to move under adjacent stone 11*a*. The further effect is to cause stone 11*a* to dislodge from its base orientation as well. As with the embodiment of FIGS. 7B/8B, the user force 40 of FIGS. 7F/8F overcomes the magnetic forces to separate the stone magnet 20*b* from the corresponding bowl magnet 24*b* such that they are no longer in their closest and most collinear orientation, but also overcomes the additional magnetic forces to separate the stone magnet 20*a* from its corresponding bowl magnet 24*a* such that they are also no longer in their closest and most collinear orientation. As a result, the user experiences a reduced magnetic resistance as force 40 is continued to be applied.

FIGS. 7G/8G illustrate the effect of the continued application of user force 40, in particular of causing stone 11*b* to further move away from magnet 24*b*, while at the same time lifting stone 11*a* away from its corresponding magnet 24*a*. As such, the magnetic attraction between stone magnet 20*b* from the corresponding bowl magnet 24*b* is greatly reduced, which is experienced by the user in the continued application of force 40. At the same time, however, magnet 20*b* of stone 11*b* now experiences an attraction to, not only the corresponding magnet 20*a* of stone 11*a* as a result of magnets 20*a* and 20*b* being moved closer to each other, but also to bowl magnet 24*a*. Thus, not only does the user experience a greatly magnetic resistance to force 40, but now in fact begins to experience the increasing attractive force as stone 11*b* slides across the bowl.

Finally, FIGS. 7H/8H illustrate the orientation in which external user force 40, together with the increasing magnetic attraction between magnets 20*a* and 20*b* and between magnet 20*b* and bowl magnet 24*a*, has caused stone 11*b* to slide completely under stone 11*a*, such that stones 11*a* and 11*b* are again stacked, albeit in a reversed order than in FIG. 7D/8D. As described above, the user may experience the application of force 40 as 'snapping' the stones together in a similar manner as above whereby the user does not feel as if the stones are at risk of falling by the application of force 40 due to the magnetic forces.

It should be appreciated that the user manipulation of the stones 11*a* and 11*b* described above with respect to FIGS. 7A-7H/8A-8H are exemplary only and that there are a wide range of fidget-based manipulations of the stones that may equally provide calming and beneficial effects to the user, and which are particularly made possible by the fidget accessory disclosed herein.

While the invention has been described with respect to a limited number of embodiments, it will be appreciated that many variations, modifications and other applications of the invention may be made. Therefore, the invention is not limited to the embodiments described herein.

What is claimed is:

1. A fidget accessory comprising:

a plurality of stones, wherein each stone comprises:

a stone lid;

a stone body; and at least one stone magnet disposed inside the stone body of a respective one of the plurality of stones;

a bowl that comprises:

a bowl base disposed at a bottom of the bowl, and on which the plurality of stones are configured to be arranged in a base orientation;

a bowl lip circumferentially surrounding a top edge of the bowl;

a bowl ramp extending between the bowl lip and the bowl base;

a leash portion, wherein the leash portion comprises a leash collar disposed on an inside surface of a leash wrap, and wherein the leash collar is configured to engage with a channel circumferentially surrounding the bowl; and one or more bowl magnets contained in the bowl base having a polarity opposite to corresponding ones of the stone magnets at least when the plurality of stones are arranged in the base orientation, wherein the one or more bowl magnets are configured to magnetically interact with said stone magnets, wherein the stone lids have a curvature that complements a curvature of the stone bodies and facilitates vertical stacking of the plurality of stones in an engaging manner.

2. The fidget accessory of claim 1, wherein the leash collar is configured to engage with the channel by way of a snap-fit.

3. The fidget accessory of claim 1, wherein the stone lid of each of the plurality of stones comprises a concave shape and the stone body of each of the plurality of stones comprises a convex curvature.

4. The fidget accessory of claim 3, wherein the concave shape of the stone lids is complementary to the convex curvature of the stone bodies.

5. The fidget accessory of claim 1, wherein the bowl lip is formed as an inwardly protruding perimeter disposed around a top edge of the bowl ramp.

6. The fidget accessory of claim 1, wherein the bowl ramp is defined by a curved region extending between the bowl lip and the bowl base.

7. The fidget accessory of claim 6, wherein the curved region of the bowl ramp comprises a concave profile that is configured to cooperate with a shape of the stone to facilitate movement of the plurality of stones along the bowl ramp.

8. The fidget accessory of claim 1, wherein the plurality of stones includes a first stone and a second stone disposed side by side adjacent to each other in the bowl.

9. A fidget accessory comprising:

first and second stones, wherein each of the first and second stones comprises a stone lid, a stone body, and first and second stone magnets disposed inside the first and second stones respectively;

a bowl that comprises a bowl base disposed at a bottom of the bowl, and on which the first and second stones are configured to be arranged side by side adjacent to each other in a base orientation; and a leash portion, wherein the leash portion comprises a leash collar disposed on an inner surface of a leash wrap, and wherein the leash collar is configured to engage with a channel circumferentially surrounding the bowl, wherein the bowl comprises a bowl magnet contained in the bowl base and has a polarity opposite to that of the first and second stone magnets, wherein the bowl magnet is configured to magnetically interact with the first and second stone magnets, wherein the bowl, and the first and second stones have complementary geometries that facilitate vertical stacking in an engaging manner and magnetic interactions therebetween, which cause the first stone to dislodge from the base orientation and move towards the second stone upon application of an external user force to the first stone in an upward direction, and which further causes the second stone to remain magnetically engaged with the bowl, and the first stone to magnetically engage with the second stone upon application of the external user force such that the first stone is vertically stacked on top of the second stone.

10. The fidget accessory of claim 9, wherein the leash collar is configured to engage the channel by way of a snap-fit arrangement.

11. The fidget accessory of claim 9, wherein each stone lid comprises a concave shape and the stone body of each stone comprises a convex curvature.

12. The fidget accessory of claim 9, wherein a bowl lip is formed as an inwardly protruding perimeter disposed around a top edge of a bowl ramp.

13. The fidget accessory of claim 12, wherein the bowl ramp is defined by a curved region extending between the bowl lip and the bowl base.

* * * * *